US007618530B2

(12) United States Patent
Satchell, Jr.

(10) Patent No.: US 7,618,530 B2
(45) Date of Patent: Nov. 17, 2009

(54) HEAVY OIL HYDROCONVERSION PROCESS

(75) Inventor: Donald P. Satchell, Jr., Chatham, NJ (US)

(73) Assignee: The BOC Group, Inc., Murray Hill, NJ (US)

( * ) Notice: Subject to any disclaimer, the term of this patent is extended or adjusted under 35 U.S.C. 154(b) by 181 days.

(21) Appl. No.: 11/524,982

(22) Filed: Sep. 21, 2006

(65) Prior Publication Data

US 2007/0158239 A1 Jul. 12, 2007

Related U.S. Application Data

(60) Provisional application No. 60/758,330, filed on Jan. 12, 2006.

(51) Int. Cl.
*C10G 11/00* (2006.01)

(52) U.S. Cl. ..... 208/113; 208/59; 208/89; 208/93; 208/94; 208/96; 208/97; 208/100; 208/102; 208/104; 208/212; 431/8; 431/9; 431/10

(58) Field of Classification Search ..... 208/59, 208/89, 93, 94, 96, 97, 100, 102, 104, 113, 208/212; 431/8, 9, 10
See application file for complete search history.

(56) References Cited

U.S. PATENT DOCUMENTS 2,620,293 A 12/1952 Blue et al.
2,762,754 A 9/1956 Offutt et al.
2,843,530 A 7/1958 Langer, Jr. et al.
2,859,169 A 11/1958 Herman
2,873,245 A 2/1959 Thompson et al.
2,987,465 A 6/1961 Johanson
2,989,461 A 6/1961 Eastman et al.
3,207,688 A 9/1965 Van Driesen
3,238,118 A 3/1966 Arey, Jr. et al.
3,487,121 A * 12/1969 Hallee ..... 585/652
4,002,556 A 1/1977 Satchell, Jr.
4,090,947 A 5/1978 Satchell, Jr.
4,115,246 A 9/1978 Sweany
4,347,120 A 8/1982 Anderson et al.

(Continued)

FOREIGN PATENT DOCUMENTS

BE 866.979 11/1978

(Continued)

OTHER PUBLICATIONS

Michael et al., "Differences in Average Chemical Structures of Asphaltene Fractions Separated from Feed and Product Oils of a Mild Thermal Processing Reaction", Energy & Fuels 2005, pp. 1598-1605, vol. 19, No. 4, American Chemical Society.

(Continued)

*Primary Examiner*—Glenn Caldarola
*Assistant Examiner*—Prem C. Singh
(74) *Attorney, Agent, or Firm*—Philip H. Von Neida

(57) ABSTRACT

A method for the efficient conversion of heavy oil to distillates using sequential hydrocracking in the presence of both supported and colloidal catalyst immediately followed by a high temperature-short residence time thermal treatment. The hydrocracker reaction products or a heavy oil and hydrogen donor diluent may be advantageously heated by direct contact with high velocity combustion products.

42 Claims, 9 Drawing Sheets

U.S. PATENT DOCUMENTS

| | | | | |
|---|---|---|---|---|
| 4,363,716 | A | 12/1982 | Greene et al. | |
| 4,389,303 | A | 6/1983 | Simo et al. | |
| 4,411,768 | A | 10/1983 | Unger et al. | |
| 4,427,535 | A | 1/1984 | Nongbri et al. | |
| 4,451,354 | A | 5/1984 | Stuntz | |
| 4,454,024 | A | 6/1984 | Singhal et al. | |
| 4,457,830 | A | 7/1984 | Kydd | |
| 4,475,592 | A * | 10/1984 | Pachovsky | 166/272.3 |
| 4,485,004 | A | 11/1984 | Fisher et al. | |
| 4,487,687 | A | 12/1984 | Simo et al. | |
| 4,495,060 | A | 1/1985 | Abrams | |
| 4,514,282 | A | 4/1985 | Poynor et al. | |
| 4,587,007 | A | 5/1986 | Rudnick | |
| 4,592,830 | A | 6/1986 | Howell et al. | |
| 4,604,186 | A | 8/1986 | Lutz et al. | |
| 4,640,765 | A | 2/1987 | Kubo | |
| 4,686,028 | A | 8/1987 | Van Driesen et al. | |
| 4,698,147 | A | 10/1987 | McConaghy, Jr. | |
| 5,164,075 | A | 11/1992 | Lopez | |
| 5,201,650 | A * | 4/1993 | Johnson | 431/9 |
| 5,288,681 | A | 2/1994 | Gatsis | |
| 5,294,329 | A | 3/1994 | Kramer | |
| 5,298,152 | A | 3/1994 | Kramer | |
| 5,362,382 | A | 11/1994 | Heck et al. | |
| 5,932,090 | A | 8/1999 | Marchionna et al. | |
| 5,980,730 | A | 11/1999 | Morel et al. | |
| 6,183,627 | B1 | 2/2001 | Friday et al. | |
| 6,274,003 | B1 | 8/2001 | Friday et al. | |
| 6,511,937 | B1 | 1/2003 | Bearden, Jr. et al. | |
| 2003/0129109 | A1 | 7/2003 | Bronicki | |
| 2005/0241993 | A1 | 11/2005 | Lott et al. | |

FOREIGN PATENT DOCUMENTS

| | | |
|---|---|---|
| EP | 0 023 802 A1 | 2/1981 |
| WO | WO 2004/056947 | 7/2004 |
| WO | WO 2204/056946 | 7/2004 |

OTHER PUBLICATIONS

We et al., "Molecular-Thermodynamic Framework for Asphaltene-Oil Equilibria", AlChE Journal, May 1998, pp. 1188-1199, vol. 44, No. 5.

* cited by examiner

HEAVY OIL HYDROCONVERSION PROCESS

BACKGROUND OF INVENTION

The present invention relates to a method for the production and use of hydrogen donor solvents to increase heavy oil-to-hydrocarbon distillate conversion efficiency.

Terminology is important, especially for a complex field like hydrocarbon processing that progressed in parallel and very non-linear scientific and engineering practice pathways. Originally, heavy oils were hydrocarbons with a high density for a given boiling point range. However, the term heavy oil is often used interchangeably with high boiling by practicing engineers because most oil fractions with higher densities also have higher boiling points. However, some highly paraffinic oils or oil fractions may have significantly higher boiling points than much heavier, i.e., denser, aromatic oils or oil fractions. For the purposes of this invention, a heavy oil contains a significant quantity of a high density vacuum residual oil. Residual oils, also called residua or resids, are typically those fractions which are non-distillable under given conditions and remain at the bottom of a vacuum distillation tower and have equivalent normal boiling point (NBP) greater than approximately 525° C.

The efficiency of processes to convert heavy oils to distillates is generally determined by the relative rates of cracking reactions to produce lower molecular weight species and the rate of free radical polymerization reactions to produce higher molecular weight and less soluble species. The polymerization reaction rate dramatically accelerates to form solid petroleum coke when the polymerization reaction products form a separate mesophase. Therefore, control of both the heavy oil conversion and process solvent and solute properties are important.

The solubility of residual oil components in alkanes (paraffins), e.g., propane, butane, pentane, hexane, and heptane) has been used by petroleum refiners to up-grade residual oils and by researchers to obtain more detailed information about these component properties. A two-product commercial deasphalting unit produces deasphalted oil (DAO) and asphaltene streams and a three-product commercial deasphalting unit produces DAO, resin, and asphalt streams. The DAO, resin, and asphalt stream properties vary over a wide range depending on the deasphalter operating conditions. Broadly, the deasphalter product aromaticity and molecular weight have the following ranking: DAO<resin<asphaltene. Petroleum chemists use similar terms, with substantially different meanings, to specify residual oil solubility classes. For petroleum chemists, asphaltenes and maltenes are terms used to describe the insoluble and soluble fractions of a vacuum residue or deasphalter asphalt product. They are defined by the respective insolubility and solubility of these fractions in light hydrocarbons such as n-pentane, n-hexane, or n-heptane. As a result, pentane-insoluble-asphaltenes would have a lower molecular weight and aromaticity than heptane-insoluble-asphaltenes. The petroleum chemists usually define oils and resins as maltene species that readily adsorb on a packing and can be readily desorbed using alkane and polar solvents, respectively.

This invention defines (1) coke precursors as marginally soluble species in the heavy oil conversion process solvent and (2) process solvent properties in terms of the equivalent deasphalter DAO and asphaltene residual product properties. Theoretical methods to estimate solubility can be used to analyze heavy oil conversion process data [Jianzhong Wu, John M. Prausnitz, and Abbas Firoozabadi, "Molecular-Thermodynamic Framework for Asphaltene-Oil Equilibria", AIChE Journal, Vol. 44, No. 5, May 1998].

This invention provides a heavy oil-to-distillates conversion method that is differentiated from and superior to the related art. This task is complicated by the fact that both this invention and the related art utilize very complex and poorly understood thermal cracking reactions to convert heavy oil to distillates. Molecular weight, elemental analysis, nuclear magnetic resonance (NMR) spectroscopy, and X-ray diffraction (XRD) analyses can be used to estimate the average structural data for hydroconversion feed and products [George Michael, Mohammad Al-Siri, Zahida Hameed Khan, and Fatima A. Ali, "Differences in Average Chemical Structures of Asphaltene Fractions Separated from Feed and Product Oils of a Mild Thermal Processing Reaction," Energy Fuels, Vol. 19, No. 4, pages 1598-1605, 2005]. Even these very time consuming and expensive analytical methods provide only very general guidance to assess process performance. As a result, heavy oil process developers are forced to use less rigorous and costly methods to characterize, evaluate, and improve heavy oil conversion processes. Process development teams tend to use somewhat different approaches to analyze their processes and assess their performance relative to alternative approaches. The present inventor has discovered that the very general reaction system on FIG. 1 provides a useful framework to assess and guide the development of the present invention. Broadly, this oversimplified process framework envisions that heavy oils are converted to distillates via thermal cracking reactions, which also initiate free radical polymerization reactions that are terminated by either hydrogen transfer or coking reaction.

More specifically, the conversion process is initiated by thermal cracking of a carbon-carbon bonds (R—R', where R and R' represent the feedstock structure on either side of the ruptured bond) via Reaction 1 to form short lived free radical intermediate species (R. and R'.). These unstable free radical species can react with labile hydrogen atoms in the heavy oil to produce the desired stable reaction product via Reaction 2 (or Reaction 6). The labile hydrogen is typically a naphthenic hydrogen atom that is bonded to a carbon atom that is in the alpha position relative to an aromatic carbon (see hydrogen donor diluent example on FIG. 1). Hydrogen donor diluents are generally highly aromatic distillates, e.g. fluid catalytic cracking cycle (decant) oils, thermal tars, or coker gas oils. The hydrogen donor diluent can be regenerated via Reaction 5. Residual oil species, particularly the highly aromatic asphaltene and resin components, can provide labile hydrogen to produce stable cracked products via Reaction 6 using an unsupported hydrotreating catalyst. Since asphaltene species are generally too large to be effectively hydrogenated using a support hydrotreating catalyst, asphaltene fraction labile hydrogen species are most effectively produced using an unsupported colloidal catalyst hydrotreating catalyst via Reaction 7. Free radical polymerization reactions (Reaction 3) can produce progressively larger and less soluble species (R—R'—R. & R—R'—R'.) until these species reach the solution solubility limit, form a separate mesophase, and then very rapidly produce the less desirable solid coke product via Reaction 4. This framework will be used in the discussion of the related art.

DESCRIPTION OF THE RELATED ART

Visbreaking is a well-known petroleum refining process in which heavy oils are thermally cracked, under comparatively mild conditions, to provide products having lower viscosities and pour points to reduce the amount of less-viscous and more valuable blending oils required to produce a fuel oil product. Early visbreaking processes typically heated heavy oil in a fired heater to between 825° F. (441° C.) to 900° F. (482° C.) at moderate pressure with the maximum resid oil converted to distillates is limited by coke formation. More severe cracking conditions are not possible because of excessive coke precursor and coke formation. U.S. Pat. No. 2,762,754 taught that the maximum resid conversion could be significantly increased by increasing the visbreaker operating temperature from 900° F. (482° C.) to 1000° F. (538° C.). The rate of thermal cracking reactions (Reaction 1) increase much more rapidly with increasing temperature (activation energy≈45 kcal/mole) than free radial polymerization reaction rate (activation energy≈5 kcal/mole). As a result, it is not surprising that the maximum resid conversion increases with increasing operating temperature.

U.S. Pat. No. 2,843,530 further increased the maximum resid conversion by thermal cracking of the heavy oil in the presence of a hydrogen donor diluent. The hydrogen donor diluent was produced by catalytic hydrogenation of an aromatic distillate stream comprising thermal tars, catalytic cycle stocks, and lube oil extract. The subsequent hydrogen donor diluent cracking (HDDC) process development effort focused on HDDC process improvements and more cost effective hydrogen donor solvent production and regeneration methods.

The hydrogen donor diluent cracking (HDDC) process development effort focused on the use of additives, optimization of HDDC process operating conditions and pre-treatment of the feeds. U.S. Pat. No. 2,873,245 teaches a two-stage HDDC process. U.S. Pat. Nos. 2,989,461; 4,389,303; and 4,592,830 teach the addition of molecular hydrogen to the HDDC process feed to increase the maximum resid conversion. U.S. Pat. No. 4,587,007 teaches the addition of thiols to the HDDC process feed. U.S. Pat. Nos. 4,454,024; 4,487,687; and 4,485,004 teach the addition of molecular hydrogen and fluid catalytic cracking catalyst, coke solids, and hydrotreating catalyst, respectively, to the hydrogen donor diluent cracking process feed. U.S. Pat. No. 4,698,147 teaches a method to further increase the maximum operable resid conversion by operating at high temperature [>900° F. (482° C.)], low pressure [<1100 psig (75.8 bar)], and sufficient residence time to achieve the desired resid conversion.

U.S. Pat. No. 4,002,556 further increased the hydrogen donor diluent process efficiency by introducing the hydrogen donor diluent at multiple locations to optimize the rate of hydrogen transfer. U.S. Pat. No. 4,363,716 teaches recycle of a portion of the unconverted resid to increase the overall resid conversion. U.S. Pat. Nos. 4,451,354 and 4,514,282 teach hydrotreating the resid feed and recycle resid in the presence of a supported catalyst prior to treatment in a hydrogen donor diluent cracking process. U.S. Pat. Nos. 6,183,627 and 6,274,003 teach deasphalting the fresh feed and recycle resid feeds to the HDDC process. U.S. Pat. Nos. 4,347,120 and 4,604,186 teach methods to further increase the overall resid conversion by feeding the unconverted resid from the HDDC process to a delayed coker. U.S. Pat. No. 4,115,246 used partial oxidation of the unconverted resid from the HDDC process to produce a synthesis gas for hydrogen production. U.S. Pat. Nos. 3,238,118 and 4,363,716 teach a method to use a distillate hydrocracking unit to produce the distillate hydrogen donor diluent. U.S. Patent Application US 2003/0129109 teaches a method to produce the hydrogen donor precursor via thermal cracking. U.S. Pat. No. 4,090,947 teaches a method to use a premium coker gas oil as the hydrogen donor precursor.

Although, remarkably efficient heavy oil hydrogen donor diluent cracking processes have been developed over time, no commercially attractive approach has been identified to produce or regenerate the hydrogen donor diluent feed. As a result, there was a strong commercial incentive to develop a single-step heavy hydrocracking process.

U.S. Pat. No. 2,987,465 first introduced the ebullated bed hydrocracking reactor concept. The expanded catalyst bed was much less susceptible to plugging problems associated with heavy oil hydrocracking than the previous fixed catalyst bed designs. However, this design also had a major disadvantage: only the feed oil was available to expand the catalyst bed, which required using either inconveniently large reactor height to diameter ratio or small and difficult to separate catalyst particles. U.S. Pat. No. 3,207,688 eliminated this problem by adding a gas-catalyst-oil disengagement zone and oil recycle line. Virtually all the modern heavy oil hydrocrackers are based on this general design concept with many other mechanical and process improvements.

However, the heavy oil hydrocracker concept also has a significant problem: The resid thermal cracking reactions (Reaction 1 on FIG. 1) must operate at the same temperature as the hydrogenation (Reactions 5 and 7 on FIG. 1) and the free radical termination reactions (Reaction 2 and 6 on FIG. 1). As a result the process developer faces the following situation:

The rate of the thermal cracking reactions (Reaction 1 on FIG. 1) increase more rapidly than the rate of the hydrogenation (Reactions 5 and 7 on FIG. 1) and free radical termination reactions (Reaction 2 and 6 on FIG. 1) with increasing temperature. Therefore, the ratio of the hydrogenation reaction rate to thermal cracking reaction rate decreases with increasing temperature.

Fortunately, the hydrogenation reaction rate to the thermal cracking reaction rate ratio required to maintain reactor operability also decreases with increasing temperature (U.S. Pat. No. 4,002,556). Unfortunately, the actual hydrogenation reaction rate to thermal cracking reaction rate ratio decreases more rapidly than the required ratio to maintain reactor operability (U.S. Pat. No. 4,427,535). Therefore, heavy oil hydrocrackers have a maximum operating temperature that is a function of the catalyst hydrogenation activity and feedstock properties, primarily the concentration and effectiveness of hydrogen donor species.

U.S. Pat. No. 4,427,535 first faced this problem by teaching that the ebullated bed hydrocracker operating temperature must be limited such that the percent Ramsbottom carbon residue conversion is greater than the percent resid conversion to distillates to ensure successful operation of an ebullated resid hydrocracker. As a result, heavy oil hydrocracker development efforts have focused on methods to either remove coke precursors or increase the rate of hydrogenation to increase the maximum resid conversion and process efficiency.

U.S. Pat. No. 4,495,060 teaches the use of a rapid hydrocarbon quench of the ebullated bed hydrocracker liquid product to minimize coke formation in the product recovery system. U.S. Pat. No. 4,411,768 teaches removal of coke precursors from recycle resid feed to an ebullated bed resid hydrocracker by cooling the recycle resid, allowing the coke precursor to form a separate phase, and separating the coke precursor phase. U.S. Pat. No. 4,457,830 teaches the use of acids to remove coke precursors from recycle resid feed to an ebullated bed resid hydrocracker. U.S. Pat. No. 4,686,028 teaches the use of solvent extraction to selectively removal deasphalted oil from the resid hydrocracker to increase asphaltene solubility in the resid hydrocracker and convert the DAO to distillates more efficiently in either fixed bed hydrocracking or fluid catalytic cracking processes.

The related art has identified a wide variety of methods to increase the hydrogenation rate and the heavy oil hydrocracker maximum operable temperature and resid conversion. U.S. Pat. Nos. 4,640,765; 4,686,028; and 5,980,730 teach that the addition of a hydrogen donor solvent, deasphalter resin fraction and deasphalter DAO, respectively, to the ebullated bed hydrocracker feed increase reactor operability. U.S. Pat. No. 5,932,090 teaches the use of fine catalyst to increase the rate of hydrogenation in an entrained flow reactor with catalyst recovery and recycle. U.S. Pat. No. 5,362,382 teaches a two-stage heavy oil process, in which the first stage operates at milder conditions than the second stage. U.S. Pat. Nos. 5,164,075 and 5,288,681 teach methods to produce colloidal heavy oil catalysts that are particularly effective for hydrogenating asphaltenes. WO 2004/056946, WO 2004/056947, and U.S. Pat. Nos. 5,294,329; 5,298,152; and 6,511,937 teach methods to recover and recycle colloidal heavy oil hydrocracking catalysts. U.S. Patent Application US 2005/0241993 teaches the addition of colloidal hydrotreating catalyst to an ebullated heavy oil hydrocracker and operating the reactor gas-liquid separator within 20° F. (11° C.) of the hydrocracker temperature to decrease the rate of coke precursor formation.

Clearly, both the heavy oil hydrogen donor diluent cracking (HDDC) and hydrocracker processes have been subject to intensive and innovative development programs. However, this extensive effort has failed to find a commercially attractive approach to produce the hydrogen donor diluent or thermal crack the heavy oil under optimum conditions.

SUMMARY OF INVENTION

The present invention provides for converting heavy oils by using a resid hydrocracker or resid hydrotreater reactor to produce hydrogen donor solvent feed for a hydrogen donor cracking process with both steps operating at optimum operating conditions.

More particularly, the present invention provides for a method for hydroconversion of a heavy oil comprising (a) introducing a heavy oil feedstock and hydrogen into a first reaction zone containing a resid hydrocracking catalyst;

(b) maintaining the first reaction zone at a temperature, hydrogen partial pressure, and sufficient residence time to add between 100 and 500 standard cubic feet of hydrogen per barrel of first reaction zone heavy oil feed;

(c) separating the first reaction zone liquid and gaseous products;

(d) rapidly heating the first reaction zone liquid product to between 500 and 800° C. in a second reaction zone with a residence time sufficient to achieve an overall resid to distillate conversion between 0.70 to 0.99; and (e) rapidly quenching the second reaction zone product to less than 400° C.

The present invention further defines a method for hydroconversion of a heavy oil comprising:

(a) introducing a heavy oil feedstock and hydrogen into a first reaction zone containing a resid hydrogenation catalyst;

(b) maintaining the first reaction zone at a temperature, hydrogen partial pressure, and sufficient residence time to add between 100 and 500 standard cubic feet of hydrogen per barrel of first reaction zone liquid feed;

(c) separating the first reaction zone liquid and gaseous products;

(d) rapidly heating the first reaction zone liquid product to between 500 and 800° C. in a second reaction zone with a residence time sufficient to achieve an overall resid to distillate conversion between 0.70 and 0.99; and (e) rapidly quenching the second reaction zone product to less than 400° C.

The first reaction zone utilizes conventional particulate and/or colloidal resid hydrogenation or hydrocracking catalysts. A conventional nickel-molybdate or cobalt-molybdate on alumina catalyst with a large pore size distribution is used as a resid hydrocracking or hydrogenation catalyst to maximize access of the large resid molecules to the catalyst surface. A conventional molybdenum disulfide colloidal catalyst may be advantageously used to facilitate hydrogenation of the resid in the first reaction zone and facilitate hydrogen transfer in the second reaction zone in step d. The temperatures and pressures at which the steps of these inventions are run are typically about 370° to 470° C. for step b at a hydrogen partial pressure of about 1000 to 3000 psig. At lower temperatures in this range (about 370 to 425° C.), a fixed bed, down-flow resid hydrotreater reactor may be advantageously used. An ebullated bed resid hydrocracker may advantageously be used throughout the step b temperature range (about 370° to 470° C.). In addition, the ebullated bed resid hydrocracker can advantageously use nickel-molybdate or cobalt-molybdate on alumina catalysts with a smaller particle size than the fixed bed, down-flow resid hydrotreater reactor. For most resid feedstocks, the higher temperature operation with an ebullated bed resid hydrocracker is preferred. As a result, the detailed process description will focus on the ebullated bed resid hydrocracker case and note adjustments required for the fixed-bed, down-flow resid hydrotreater option. The residence time in step b ranges from about 5 to 60 minutes.

In step d, the residence time would typically range between 0.01 and 100 seconds. The pressure during step d is between about 5 and 1000 psig. The use of a residual oil hydrogen donor solvent, rather than the conventional distillate hydrogen donor diluent, decreases the step d minimum pressure and hydrogen donor cracking reactor volume and eliminates the requirement to recycle a distillate hydrogen donor diluent precursor. The colloidal catalyst that is added to step a is entrained with the liquid product from step c and facilitates hydrogen transfer in the step d hydrogen donor cracking process.

The present invention further provides for a method for step d comprising (a) combusting an oxidant and fuel at elevated pressure, (b) allowing the combustion products to expand to a lower pressure to form a high velocity jet, (c) using the high velocity combustion product jet to rapidly heat the heavy oil, (d) providing sufficient residence time to achieve the desired conversion of resid to distillates, and (e) rapidly quenching the reaction product to less than 400° C.

DETAILED DESCRIPTION OF THE INVENTION

Figure 1:
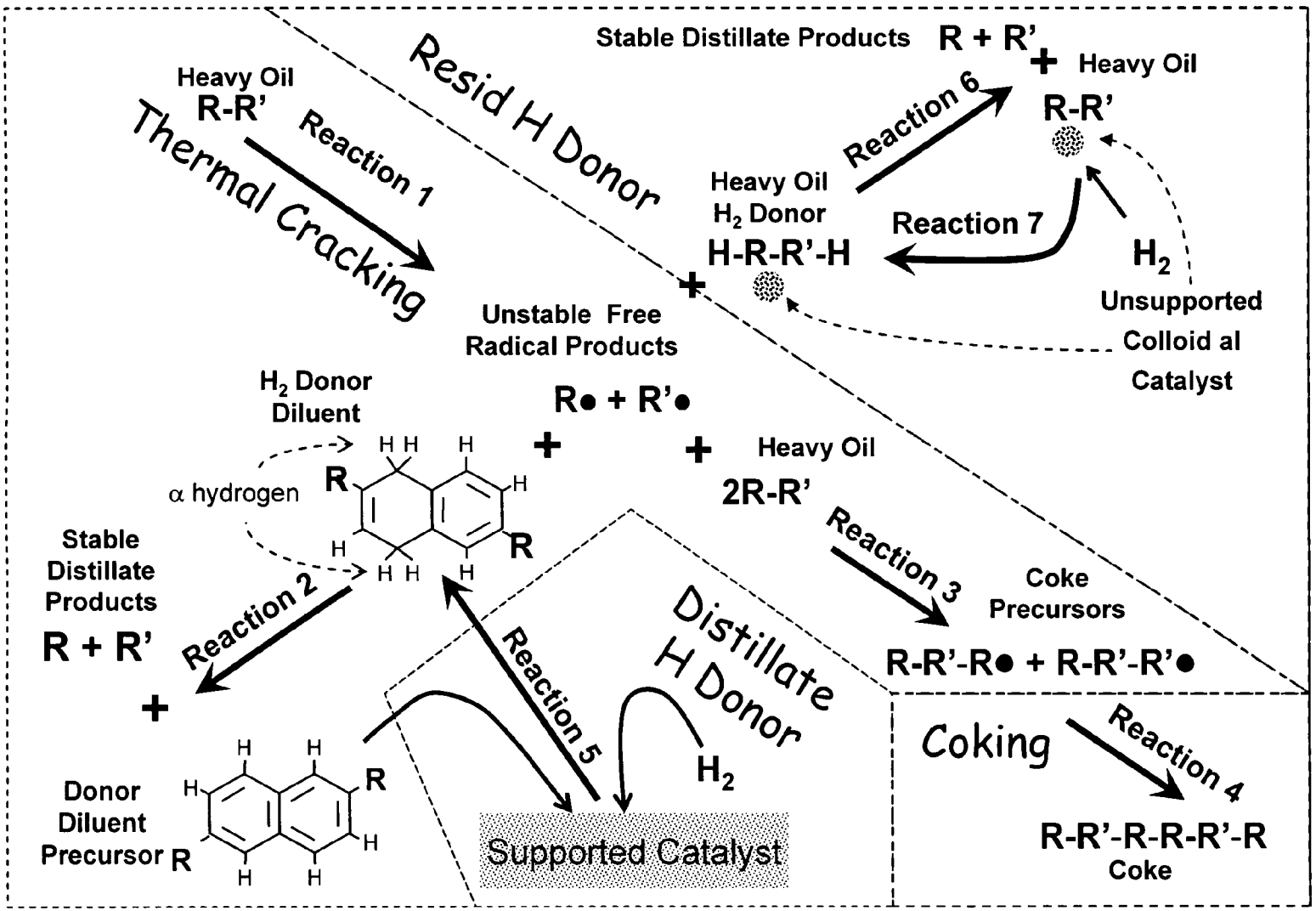
FIG. 1 is a summary of the reaction framework to analyze the related art and to more clearly define the present invention.
Figure 2:
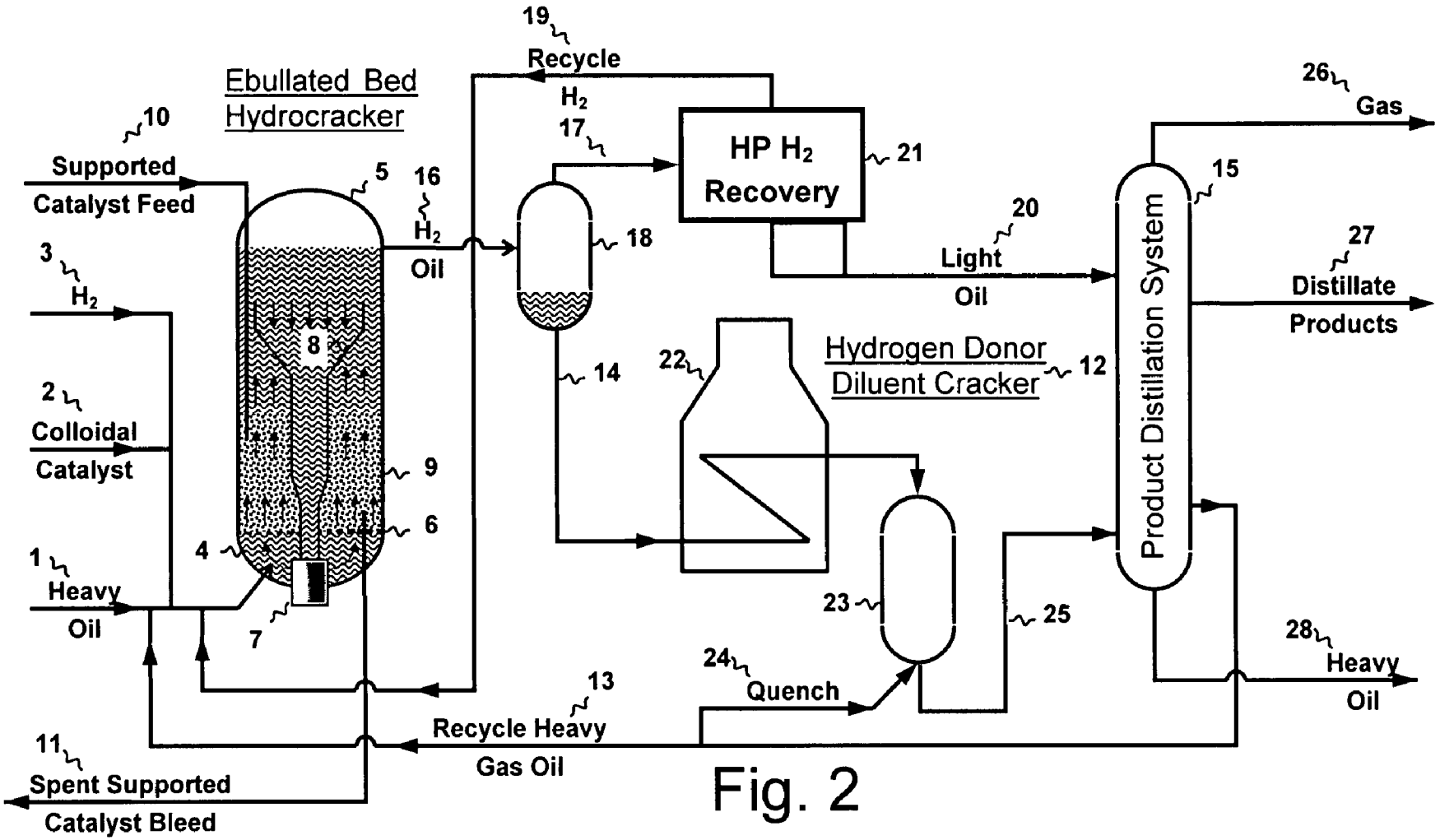
FIG. 2 is a simplified process sketch for a heavy oil conversion process combining a conventional heavy oil hydrocracking process and hydrogen donor cracking process.

The process combining heavy oil hydrocracking or hydrotreating and hydrogen donor conversion process will be described with the aid of FIG. 2. The feed heavy oil feed 1 is typically a vacuum resid with an initial boiling normal boiling point of about 975° F. (524° C.). The heavy oil feed typically contains between 5 and 40 weight percent asphaltenes and typically has a Ramsbottom carbon residue analysis value between 10 and 40 weight percent. Typically, between 0.01% and 1% of colloidal molybdenum sulfide catalyst 2 is added to the heavy oil feed 1 to primarily increase the hydrogenation of the asphaltene fraction. The hydrogen feed 3 is typically between 2 and 4 times the anticipated hydrogen consumption. Heavy oil 1, colloidal catalyst 2, and hydrogen 3 are fed into the plenum 4 of ebullated bed hydrocracker reactor 5 below the feed distributor 6. Recycle heavy oil is pumped 7 from the reactor down-corner 8 and is mixed with the heavy oil 1, colloidal catalyst 2, and hydrogen 3 feeds in the ebullated bed hydrocracker reactor 5 through plenum 4. The reactants pass through the feed distributor 6 into the ebullated catalyst bed 9. Fresh nickel-molybdate or cobalt-molybdate catalyst 10 on an alumina support is periodically fed to the ebullated catalyst bed 9 and spent catalyst 11 is withdrawn from the ebullated catalyst bed 9 to maintain activity. A conventional nickel-molybdate or cobalt-molybdate on alumina catalyst with a large pore size distribution is used to maximize access of the large resid molecules to the catalyst surface. This catalyst can be used as a resid hydrocracking catalyst in an ebullated bed reactor in the 370-470° C. temperature range or resid hydrotreater reactor at lower end of this temperature range (about 370 to 425° C.) in a down-flow, fixed bed reactor.

The ebullated bed hydrocracker reactor 5 typically operates with a hydrogen partial pressure between 1000 and 3000 psig and a temperature between 370 and 470° C. As noted earlier, a fixed-bed, down-flow resid hydrotreater reactor may be employed at the lower range of these temperatures (about 370 to 425° C.). The heavy oil residence time in the ebullated bed hydrocracker reactor 5 is adjusted such that the quantity of hydrogen added to the oil meets or exceeds the requirements of the subsequent hydrogen donor cracking process step 12. The residence time is typically about 5 to 60 minutes. The residence time for both the ebullated and fixed bed reactor is conveniently estimated using the ratio of the catalyst bed volume to the heavy oil volumetric feed rate. The hydrogen donor cracking process step 12 typically has a hydrogen requirement equivalent to 100 to 500 standard cubic feet of hydrogen per barrel of resid hydrocracker feed heavy oil 1. The standard cubic foot measurement is determined at one atmosphere absolute pressure and a temperature of 60° F. Traditionally, a 42 gallon (≈159 liter) barrel is used in this determination. A recycle heavy gas oil 13 hydrogen donor precursor can be advantageously fed to the ebullated bed hydrocracker reactor 5 to facilitate the production of an appropriate hydrogen donor cracking process feed 14. The product distillation system 15 is operated to provide the maximum practical normal boiling point end point, typically between 500 and 535° C., for the recycle heavy gas oil 13 hydrogen donor precursor. The initial normal boiling point of the recycle heavy gas oil 13 hydrogen donor precursor is adjusted to provide the desired ratio of distillate-to-resid ratio in the hydrogen donor cracking process feed 14 stream.

The ebullated bed hydrocracker reactor 5 product 16 is separated into a vapor stream 17 and hydrogen donor cracking process feed 14 in a high pressure separator 18. The high pressure separator 18 is operated with a temperature that is essentially equivalent to the ebullated bed hydrocracker reactor 5 operating temperature and minimum liquid residence time to minimize fouling in the high pressure separator 18 and downstream equipment. Since the resid hydrocracker 5 typically operates at a substantially higher pressure than the hydrogen donor 22 cracker, the gravity vapor liquid separator 18 may be advantageously replaced by a cyclone separator to decrease the liquid residence time. A recycle hydrogen stream 19 and a light oil stream 20 are typically produced in the high pressure hydrogen recovery system 21 by condensation.

Typically, the hydrogen donor cracking process feed 14 has a 524° C.– distillate to 524° C.+ resid mass ratio between 0.1 and 2. The hydrogen donor cracker 12 comprises a heating furnace 22 and optional subsequent reactor volume 23, often called a soaking drum. The hydrogen donor cracking process pressure is typically between 100 and 1000 psig.

Figure 3:
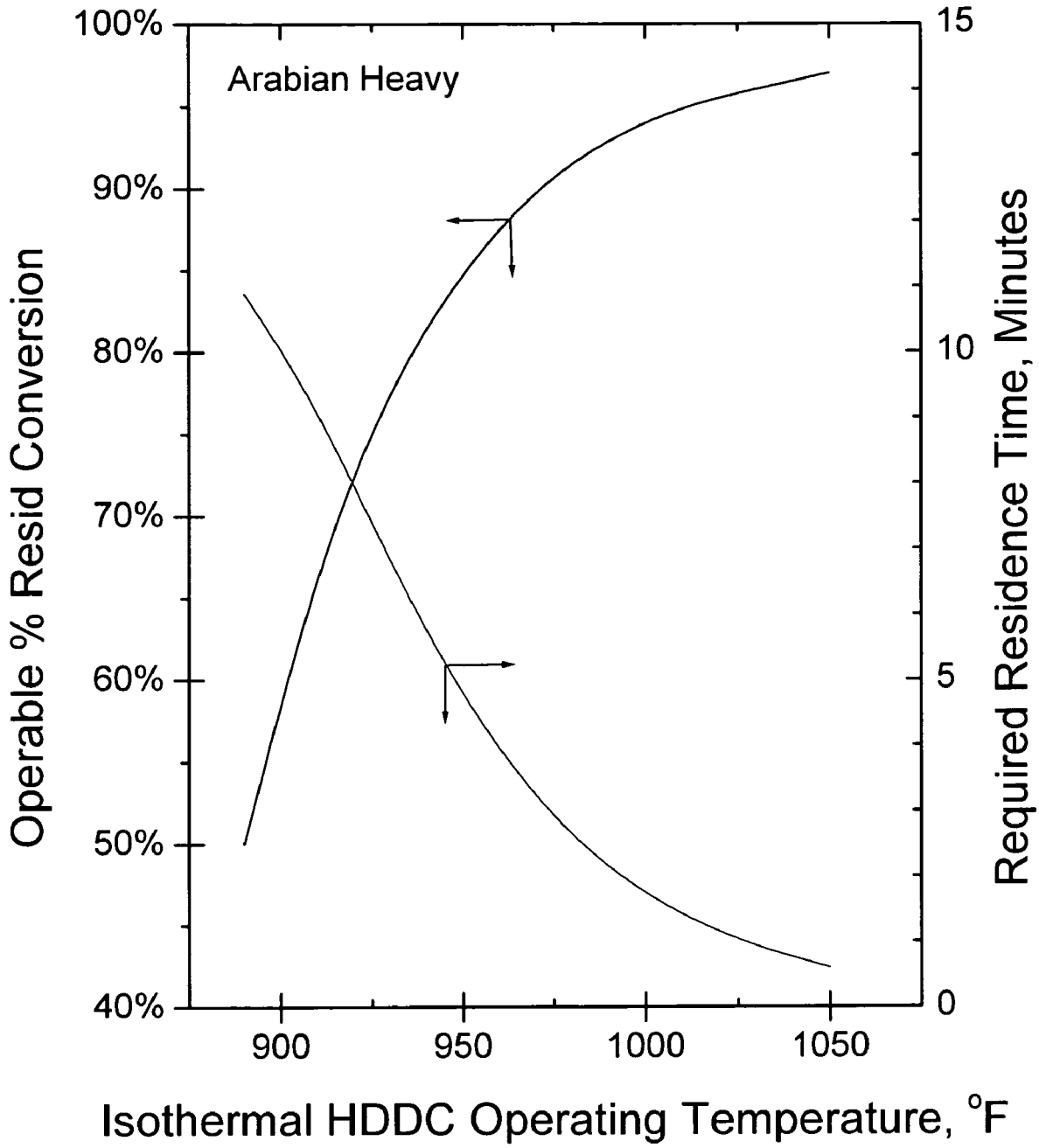
FIG. 3 is a graph of typical hydrogen donor cracking process operable resid conversions and required residence times as a function of operating temperature.
Figure 4:
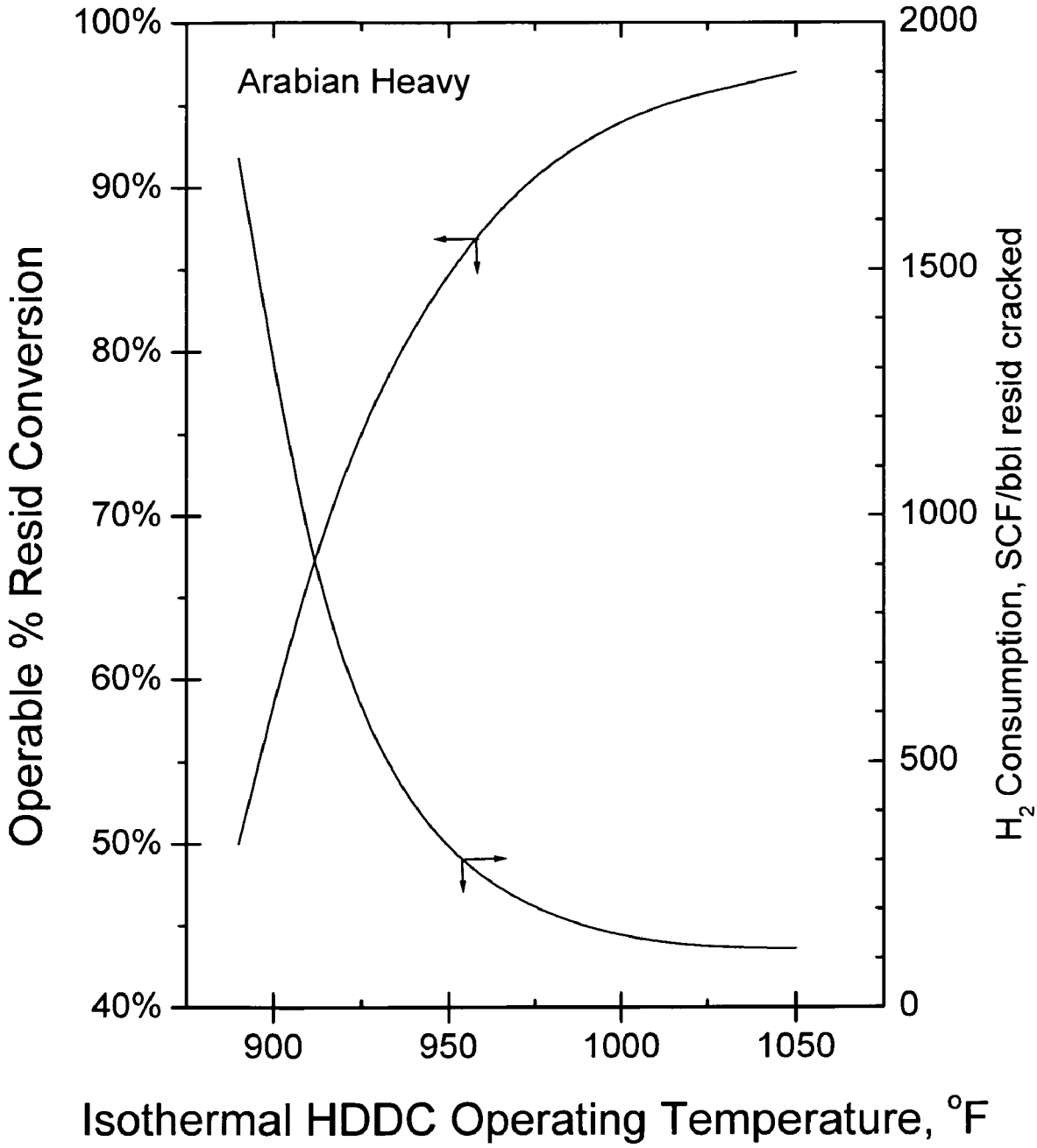
FIG. 4 is a graph of typical hydrogen donor cracking process operable resid conversions and hydrogen consumption requirements as a function of operating temperature.

FIG. 3 and FIG. 4 present typical operable resid conversions, residence time requirements, and hydrogen requirements for a typical hydrogen donor cracking process feed at typical operating conditions. FIG. 3 and FIG. 4 are used to illustrate the effect of hydrogen donor operating conditions on process performance. The numbering below refers to those process steps and lines as denoted in FIG. 2. As one increases the operating temperature, the maximum resid operable conversion asymptotically approaches 100% with a substantial reduction in both required total reactor volume and hydrogen consumption. Therefore, the heating furnace 22 should be designed to heat the hydrogen donor cracking process feed 14 as rapidly as possible. In addition, a heavy gas oil quench 24 is used to reduce the hydrogen donor cracking process step product 25 temperature to less than about 400° C. as rapidly as possible in order minimize the quantity of resid cracked at less than the maximum hydrogen donor cracking process operating temperature.

The conventional product distillation system uses moderate pressure and vacuum distillation to recover the gas 26, distillate 27, heavy gas oil (13 and 24) and heavy oil 28 products from the light oil 20 and hydrogen donor cracking process product 25. The heavy oil 28 product may contain spent colloidal catalyst that should either be recycled to the ebullated bed hydrocracker reactor 5 with the colloidal catalyst or the colloidal catalyst should be recovered from heavy oil 28 product and recycled via stream 2. For the purpose of this invention, the overall resid to distillate conversion is defined as unity minus the ratio of the mass of species with normal boiling points greater than 525° C. in stream 28 divided by the mass of the species with normal boiling points greater than 525° C. in stream 1.

Figure 5:
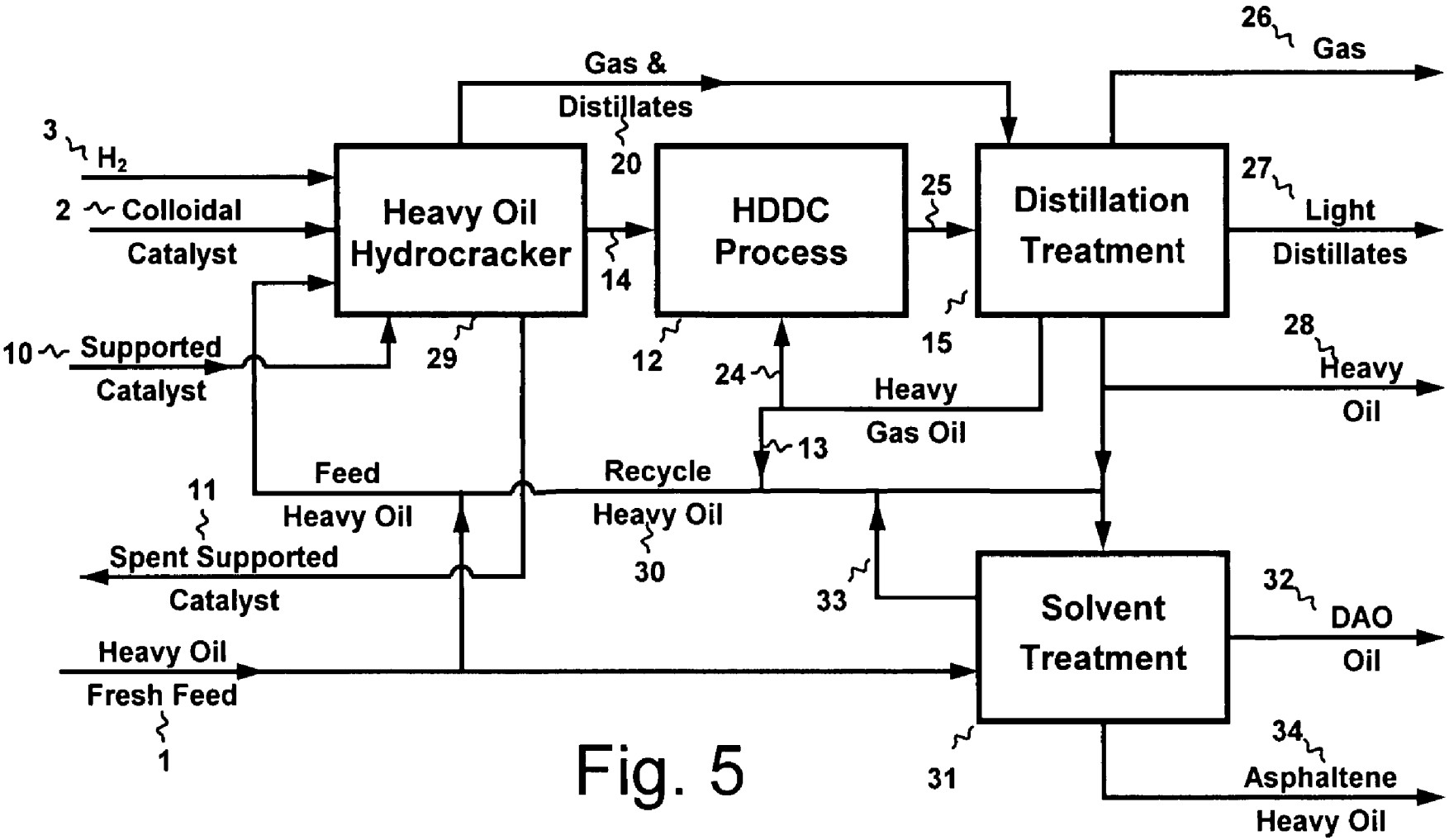
FIG. 5 is a block flow diagram that illustrates options to selectively remove undesirable species from the heavy oil conversion process and recycle desirable species to the heavy oil conversion process.

FIG. 5 is a block flow diagram to illustrate options to further improve the performance of the combination of the heavy oil hydrocracking 29 and hydrogen donor cracking 12 processes. In FIG. 5, the same numbering is employed as in FIG. 2 for like process equipment and lines. First, a portion of the heavy oil product 30 can be recycled to the hydrocracking reactor 29. This strategy allows the resid hydrocracking 29 and hydrogen donor cracking 12 processes to operate with a high resid concentration and overall conversion. Second, a solvent treatment step to separate all or a portion of the heavy oil feed 1 and/or product 28 into deasphalted oil (DAO) 32, resin 33, and asphaltene heavy oil 34. The DAO stream 32 can be more economically converted to a diesel product slate using fixed bed hydrocracking and a gasoline product slate using fluid catalytic cracking. The resin 33 stream is an outstanding hydrogen donor solvent precursor and can improve the performance of both the heavy oil hydrocracking 29 and hydrogen donor cracking 12 processes. The asphaltene heavy oil 34 contains the coke precursors and colloidal catalyst. Selective removal of the coke precursors improves the performance of the both the heavy oil hydrocracking 29 and hydrogen donor cracking 12 processes.

In fact, it is very difficult to design a heating furnace 22 that can achieve the heating rates implied by FIG. 3. As one increases the heat flux, the temperature of the heavy oil in the laminar layer of the furnace tube progressively increases relative to the average heavy oil temperature and increases the rate of coke deposition on the tube wall, which decreases both the heat and flow conductance.

Figure 6:
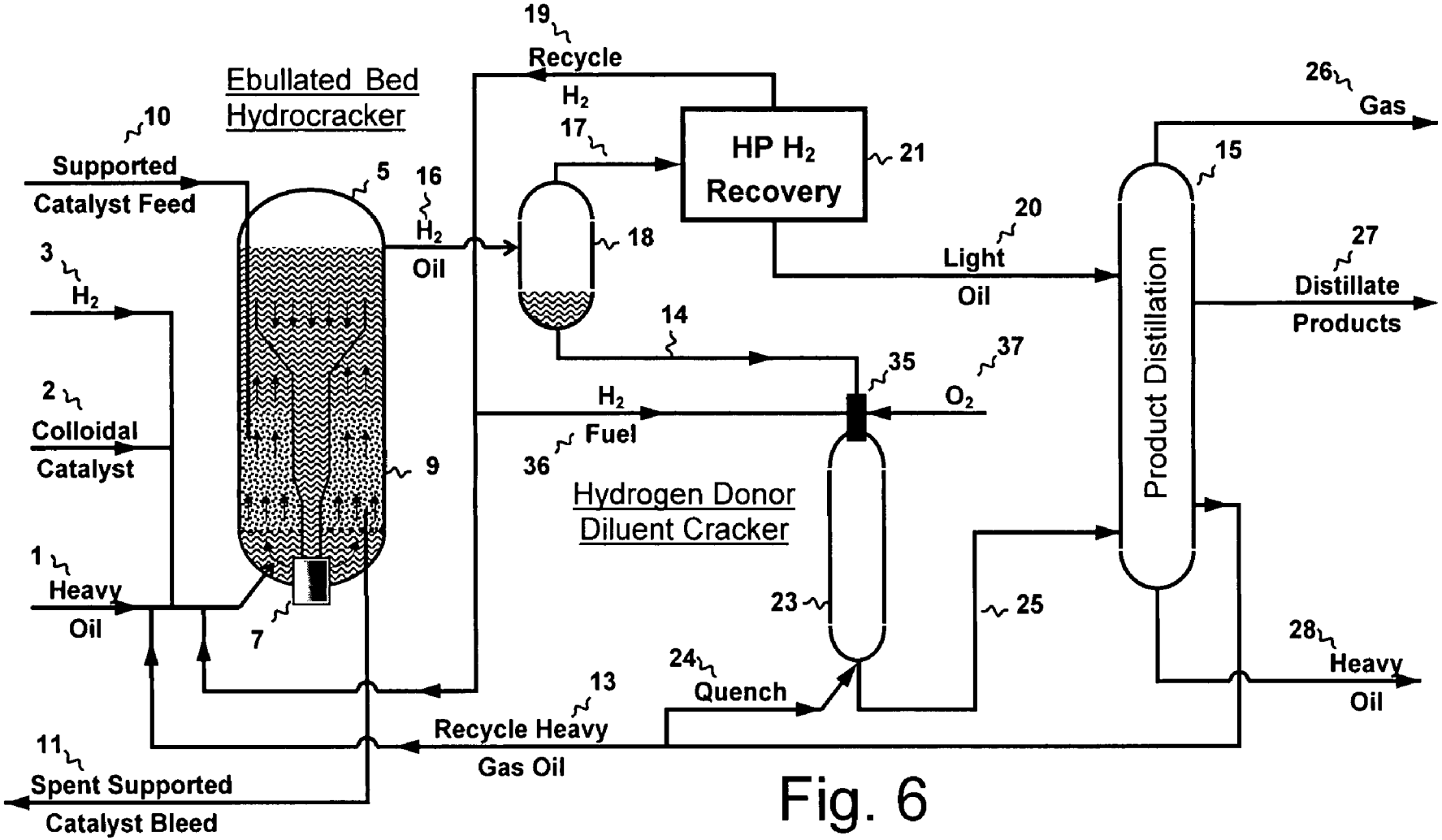
FIG. 6 a simplified process sketch for a heavy oil conversion process combining a conventional heavy oil hydrocracking process and direct contact heating hydrogen donor cracking process.

FIG. 6 illustrates an approach to used direct contact of the heavy oil with a high velocity jet of combustion products to rapidly heat the heavy oil. In FIG. 6, the same numbering is employed as in FIG. 2 for like process equipment and lines, except for those process designations noted below. The basic idea is to replace hydrogen donor cracker 12 heating furnace 22 with a burner 35 that produces a high temperature and high velocity jet by combustion of a fuel with substantially pure oxygen 37 with an excess fuel gas stream 36 containing some hydrogen atoms. In this case, recycle molecular hydrogen is a convenient source.

Figure 7:
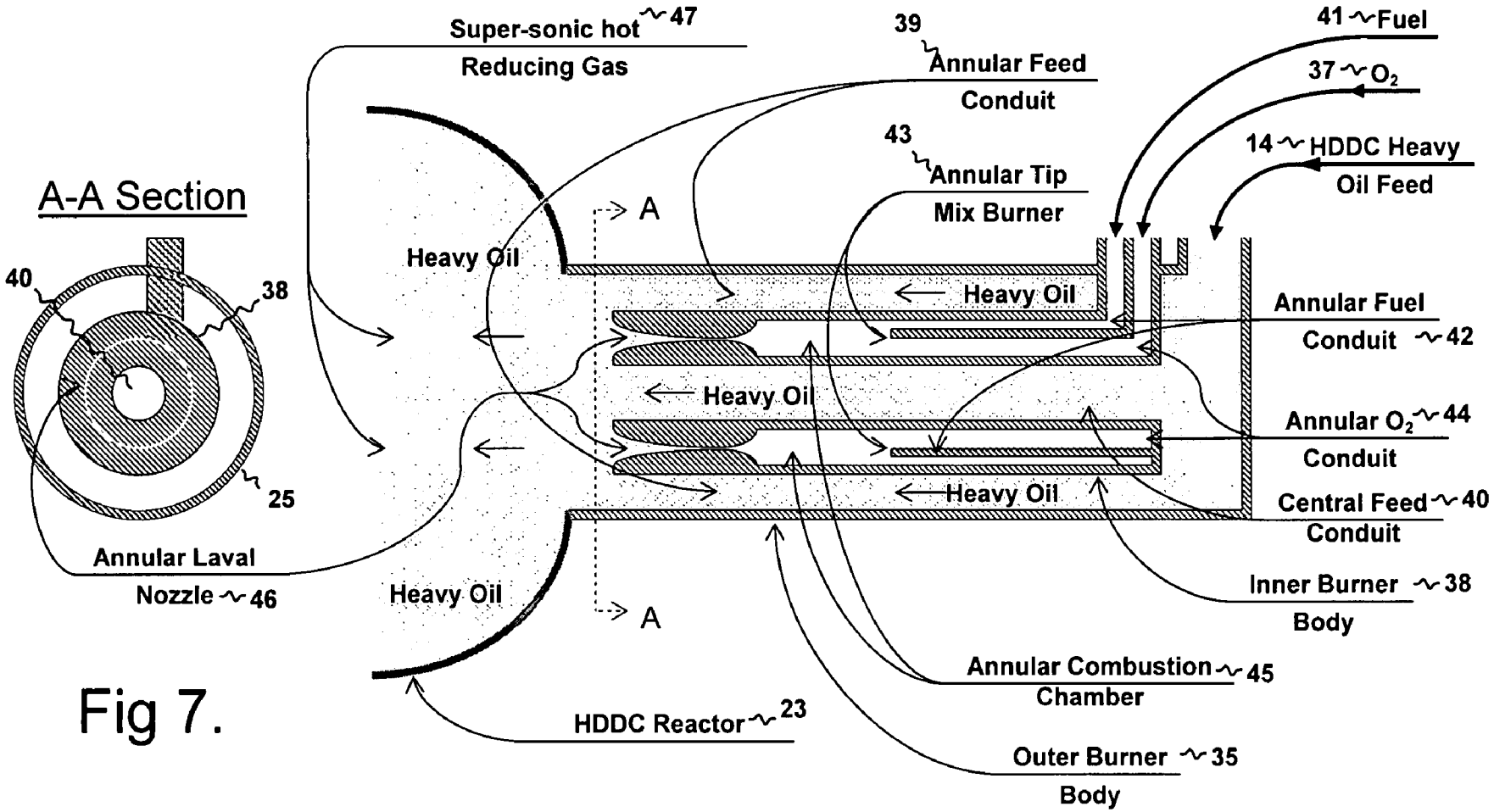
FIG. 7 is a simplified sketch of the burner for the direct contact heating hydrogen donor cracking process.

FIG. 7 is a simplified sketch of a preferred burner 35 as designated in FIG. 6 that is based on U.S. Pat. No. 6,910,431 teachings for a burner-lance for heating surfaces susceptible to oxidation or reduction in metallurgical industries. The burner-lance has an outer body 35 and inner body 38. The heavy oil feed 14 flows through annular feed conduit 39, between the burner lance outer body 35 and inner body 38, and through a central feed conduit 40. The annular feed conduit 39 and central feed conduit are designed to achieve a highly turbulent flow pattern to efficiently cool the burner-lance inner body 38. The heavy oil feed 14 is preheated to control the feed viscosity and heat transfer. The feed preheat temperature is typically between 120° C. and 370° C. The gaseous fuel 41 flows through an annular fuel conduit 42 to an annular tip mixed burner 43. In a similar fashion, the oxidant 37 flows through an annular oxidant conduit 44 to the annular tip mixed burner 43. The velocity of the fuel 41 and oxidant 37 at the burner mixing tip 43 is substantially less than the flame velocity. The burner mixing tip 43 is maintained at a temperature greater than the autothermal ignition temperature of the fuel 41 and oxidant 37. The oxidant 37 is preferably substantially pure oxygen, typically greater than 0.9 molar fraction. The fuel 41 preferably contains some hydrogen, particularly during start-up, to ensure ignition of the burner. The fuel 41 and oxidant 37 are substantially consumed in the annular combustion chamber 45. The operating pressure of the annular combustion chamber is between 2 and 10 time the operating pressure of the hydrogen donor cracking reactor 23, which operates between about 5 and 1000 psig.

An annular Laval type convergent-divergent nozzle 46 is positioned down-stream of the annular combustion chamber 45. The combustion chamber 45 pressure is between 2 and 15 times the pressure in the hydrogen donor cracking reactor 23. The hydrogen donor cracking reactor 23 typically operates between 5 and 1000 psig. A hot and high velocity annular gas jet 47 is produced. The fuel 41 and oxidant 37 flow rates are adjusted to ensure an oxidant deficiency of between 2 and 10% in the annular gas jet 47. The hydrogen donor cracking process feed 14 is intimately mixed and rapidly heated by the annular gas jet 47. The oil is heated to between 500° C. and 800° C. for a residence time between 0.01 and 100 seconds to achieve the required resid conversion. The residence time in hydrogen donor cracking reactor is conveniently estimated as the ratio of the reactor volume to the heavy oil feed rate 14. The hydrogen donor diluent cracker 23 product 25 is readily cooled to less then 400° C. using a recycle heavy gas oil quench 27 to minimize formation of a separate asphaltene phase and form coke. The hydrogen donor diluent cracker 23 product 25 is purified using a conventional distillation system 15.

Figure 8:
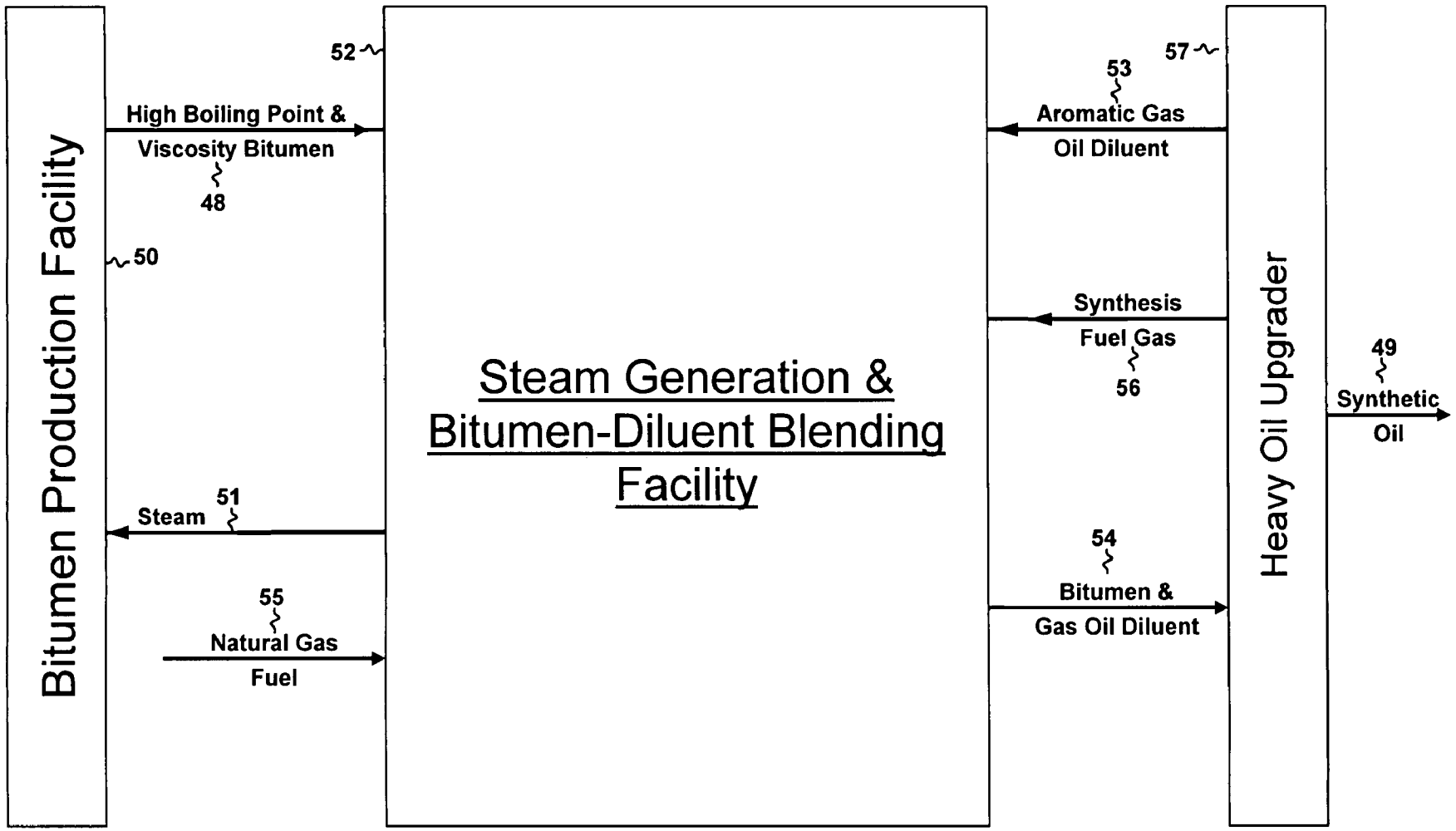
FIG. 8 is a block flow diagram for conventional processes to produce synthetic crude oil from bitumen.

This invention is particularly useful for the production of heavy oils and bitumen. FIG. 8 is a block flow diagram for a process to convert bitumen 48 from an Athabasca oil sands deposit with a high viscosity and boiling point to a synthetic crude oil 49 that is suitable feed for a conventional petroleum refinery. The conventional process has a bitumen extraction plant 50 that uses steam 51 to extract the bitumen 48 for the associated sand. The bitumen 48 may be extracted from the sand using in situ or conventional mining and steam extraction techniques. A nearby steam generation and bitumen-diluent blending facility 52 blends an aromatic gas oil diluent 53 with the viscous raw bitumen 48 to produce a bitumen-gas oil diluent blend that can be transported to the heavy oil upgrader 57. The bitumen-diluent blending facility 52 typically uses natural gas 55 or a synthesis fuel gas 56 to produce steam. The synthesis fuel gas 56 is usually produced by gasification of either coke or pitch that is produced as a by-product in the heavy oil up-grader 57. Natural gas is an expensive premium fuel and coke and pitch gasification are expensive unit operations. Therefore there is a need for a lower cost technique to produce a synthetic crude oil.

Figure 9:
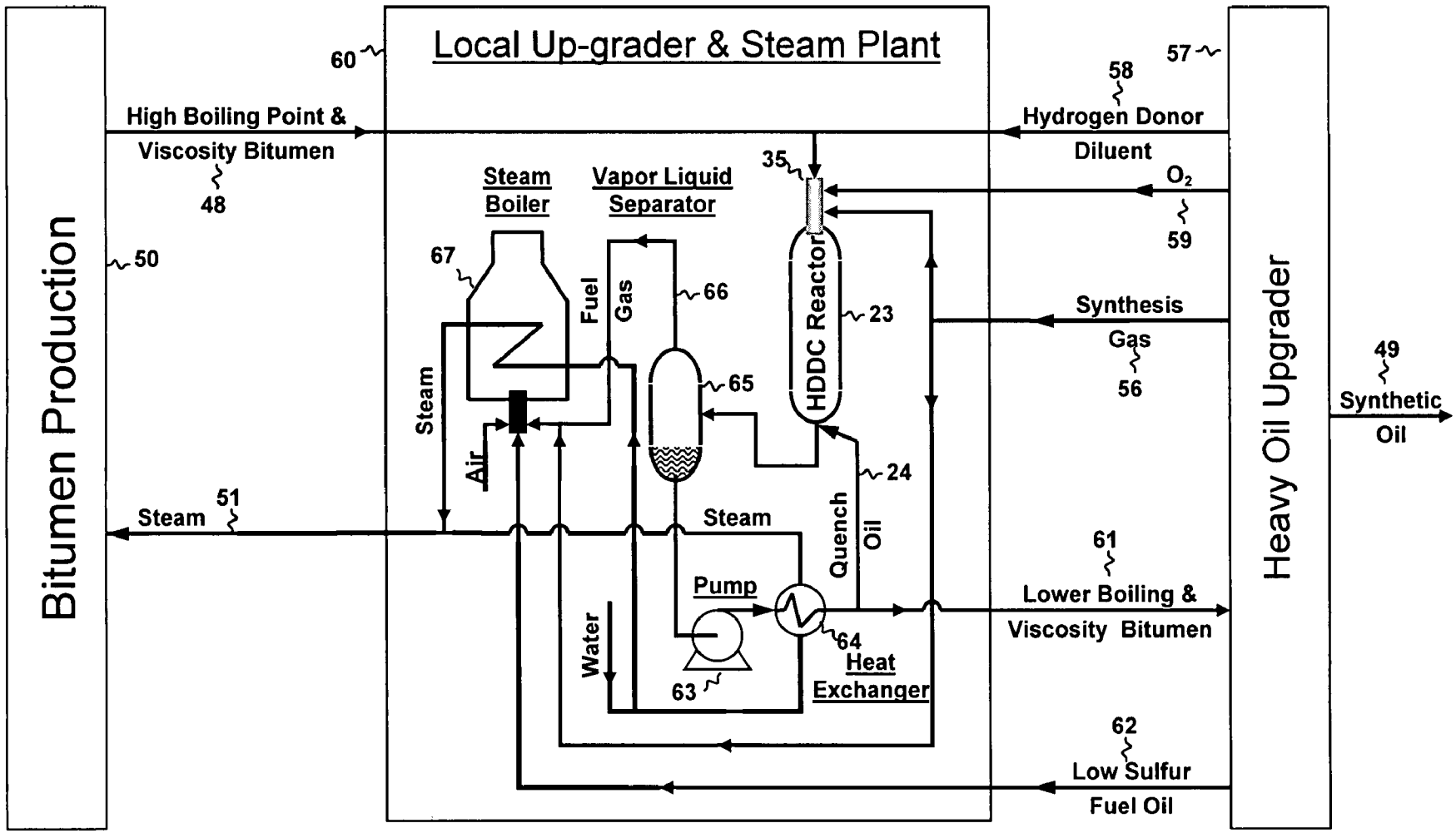
FIG. 9 is block flow diagram for a hydrogen donor cracking process for the hydroconversion of bitumen to distillates for upgrading.

FIG. 9 is a block flow diagram for a process to use the hydrogen donor diluent cracking process to decrease the quantity of heavy oil or petroleum coke that must be gasified and more cost effectively produce distillates from a bitumen heavy oil 48. In this process, the heavy oil upgrader 57 partially hydrogenates the aromatic gas oil diluent 53 to produce a hydrogen donor diluent 58. The heavy oil upgrader 57 also typically produces large quantities of oxygen for pitch or coke gasification. As a result, a portion of this oxygen production 59 can be used by the local up-grader and steam plant 60 to convert the high viscosity and boiling point raw bitumen feed 48 to a much less viscous and lower boiling point distribution feed 61. As the operations of the hydrogen donor cracking reactor 23 become more severe, the synthesis gas 56 production decreases and more lower cost low-sulfur gas oil 62 becomes available as a fuel for steam 51 production. Since pitch and petroleum gasifiers have relatively low plant availability factors and gas oil fuel 62 can be more easily stored than the synthesis gas fuel 56, the overall plant reliability increases.

The operation of the hydrogen donor cracking reactor 23 with the raw bitumen 48 and hydrogen donor diluent 58 blend is essentially equivalent to the operations with the ebullated bed hydrocracker heavy oil product 14. The major differences arise from integration of the hydrogen donor cracking reactor 23 and steam 51 production. A pump 63 is used to circulate the quench oil 24 through heat exchanger 64 to produce steam 51 for the bitumen production facility 50. A gas-liquid separator 65 removes the gaseous cracked products and combustion products 66 from the quench oil 24. A conventional steam boiler uses the balance of the synthesis gas 56 and low sulfur fuel oil 62 to produce the balance of the steam 51 requirement for the bitumen production facility 50.

While this invention has been described with respect to particular embodiments thereof, it is apparent that numerous other forms and modifications of the invention will be obvious to those skilled in the art. The appending claims in this invention generally should be construed to cover all such obvious forms and modifications which are within the true spirit and scope of the present invention.

I claim:

1. A method for the hydroconversion of a heavy oil comprising (a) introducing a heavy oil feedstock and hydrogen into a first reaction zone containing a resid hydrocracking catalyst;

(b) maintaining said first reaction zone at a temperature, hydrogen partial pressure, and sufficient residence time to add between 100 and 500 standard cubic feet of hydrogen per barrel of the first reaction zone heavy oil feed;

(c) separating said first reaction zone liquid product and gaseous products;

(d) rapidly heating said the first reaction zone liquid product to between 500 and 800° C. in a second reaction zone by combusting an oxidant and fuel at elevated pressure; allowing the combustion products to expand to a lower pressure to form a high velocity jet; and rapidly heating the liquid product from the first reaction zone with the said high velocity jet;

(e) providing sufficient residence time to convert between 70 and 90% of the reside to distillates; and (f) rapidly quenching said second reaction zone product to less than 400° C., thereby inhibiting the formation of coke.

2. The method as claimed in claim 1 wherein said first reaction zone is an ebullated bed resid hydrocracker.

3. The method as claimed in claim 1 wherein said resid hydrocracking catalyst is a particulate nickel-molybdate or cobalt-molybdate catalyst on an alumina support.

4. The method as claimed in claim 1 wherein said resid hydrocracking catalyst is a particulate nickel-molybdate or cobalt-molybdate catalyst on an alumina support and a colloidal molybdenum disulfide catalyst.

5. The method as claimed in claim 1 wherein the temperature of step b is between about 370° C. and 470° C.

6. The method as claimed in claim 1 wherein the hydrogen partial pressure of step b is between about 1000 to 3000 psig.

7. The method as claimed in claim 1 wherein the residence time of step b is about 5 to 60 minutes.

8. The method as claimed in claim 1 wherein step c is performed in a gravity vapor liquid separator.

9. The method as claimed in claim 1 wherein step c is performed in a cyclone separator.

10. The method as claimed in claim 1 wherein step c is performed at a temperature of about 370° C. to 470° C. and a pressure of about 1000 to 3000 psig.

11. The method as claimed in claim 1 wherein step d is performed at a pressure between 5 and 1000 psig.

12. The method as claimed in claim 1 wherein the residence time in step d is between 0.01 and 100 seconds.

13. The method as claimed in claim 1 wherein the oxidant and fuel combustion occurs at a pressure between 2 and 10 times the second reaction zone pressure.

14. The method as claimed in claim 1 where step f is performed using a recycle distillate quench stream.

15. The method as claimed in claim 1 in which the first reaction zone heavy oil feed comprises fresh feed and recycled heavy oil from the second reaction zone.

16. The method as claimed in claim 1 in which the first reaction zone heavy oil feed comprises fresh feed and recycled heavy gas oil from the second reaction zone.

17. The method as claimed in claim 1 further comprising solvent treatment to separate the heavy oil product from the second reaction zone into deasphalted oil, resin and asphaltene streams.

18. The method as claimed in claim 17 to produce a resin stream for recycle to the first reaction zone.

19. The method as claimed in claim 1 further comprising the production of steam.

20. The method as claimed in claim 19 wherein said steam is produced by circulating quench oil through a heat exchanger.

21. The method as claimed in claim 19 wherein said steam is employed in a bitumen production facility.

22. A method for the hydroconversion of a heavy oil comprising (a) introducing a heavy oil feedstock and hydrogen into a first reaction zone containing a resid hydrogenation catalyst;

(b) maintaining said first reaction zone at a temperature, hydrogen partial pressure, and sufficient residence time to add between 100 and 500 standard cubic feet of hydrogen per barrel of the first reaction zone heavy oil feed;

(c) separating said first reaction zone liquid product and gaseous products;

(d) rapidly heating said first reaction zone liquid product to between 500 and 800° C. in a second reaction zone by combusting an oxidant and fuel at elevated pressure; allowing the combustion products to expand to a lower pressure to form a high velocity jet; and rapidly heating the liquid product from the first reaction zone with the said high velocity jet;

(e) providing sufficient residence time to convert between 70 and 90% of the reside to distillates; and (f) rapidly quenching said second reaction zone product to less than 400° C. thereby inhibiting the formation of coke.

23. The method as claimed in claim 22 wherein said first reaction zone is a fixed bed, down flow resid hydrotreater.

24. The method as claimed in claim 22 wherein said resid hydrogenation catalyst is a particulate nickel-molybdate or cobalt-molybdate catalyst on an alumina support.

25. The method as claimed in claim 22 wherein said resid hydrogenation catalyst is a particulate nickel-molybdate or cobalt-molybdate catalyst on an alumina support and a colloidal molybdenum disulfide catalyst.

26. The method as claimed in claim 22 wherein the temperature of step b is between about 370° C. and 425° C.

27. The method as claimed in claim 22 wherein the hydrogen partial pressure of step b is between about 1000 to 3000 psig.

28. The method as claimed in claim 22 wherein the residence time of step b is about 5 to 60 minutes.

29. The method as claimed in claim 22 wherein step c is performed in a gravity vapor liquid separator.

30. The method as claimed in claim 22 wherein step c is performed in a cyclone separator.

31. The method as claimed in claim 22 wherein step c is performed at a temperature of about 370° C. to 425° C. and a pressure of about 1000 to 3000 psig.

32. The method as claimed in claim 22 wherein step d is performed at a pressure between 5 and 1000 psig.

33. The method as claimed in claim 22 wherein the residence time in step d is between 0.01 and 100 seconds.

34. The method as claimed in claim 22 wherein the oxidant and fuel combustion occurs at a pressure between 2 and 10 times the second reaction zone pressure.

35. The method as claimed in claim 22 where step f is performed using a recycle distillate quench stream.

36. The method as claimed in claim 22 in which the first reaction zone heavy oil feed comprises fresh feed and recycled heavy oil from the second reaction zone.

37. The method as claimed in claim 22 in which the first reaction zone heavy oil feed comprises fresh feed and recycled heavy gas oil from the second reaction zone.

38. The method as claimed in claim 22 further comprising solvent treatment to separate the heavy oil product from the second reaction zone into deasphalted oil, resin and asphaltene streams.

39. The method as claimed in claim 38 to produce a resin stream for recycle to the first reaction zone.

40. The method as claimed in claim 22 further comprising the production of steam.

41. The method as claimed in claim 40 wherein said steam is produced by circulating quench oil through a heat exchanger.

42. The method as claimed in claim 40 wherein said steam is employed in a bitumen production facility.

* * * * *